United States Patent [19]

Fischer et al.

[11] Patent Number: 4,927,332

[45] Date of Patent: May 22, 1990

[54] VANE PUMP

[75] Inventors: Horst Fischer, Lohr; Karl Staub, Frammersbach, both of Fed. Rep. of Germany

[73] Assignee: Mannesmann Rexroth GmbH, Lohr, Fed. Rep. of Germany

[21] Appl. No.: 852,714

[22] Filed: Apr. 16, 1986

[30] Foreign Application Priority Data

Apr. 17, 1985 [DE] Fed. Rep. of Germany ..... 3513923

[51] Int. Cl.[5] ..... F04B 49/08

[52] U.S. Cl. ..... 417/299; 417/310

[58] Field of Search ..... 417/220, 299, 454, 310, 417/281

[56] References Cited

U.S. PATENT DOCUMENTS

| | | | |
|---|---|---|---|
| 2,878,753 | 3/1959 | Adams et al. | 417/310 |
| 3,743,445 | 7/1973 | Dworak | 417/220 |
| 3,901,628 | 8/1975 | Bornholt | 417/299 |

*Primary Examiner*—Leonard E. Smith

*Attorney, Agent, or Firm*—Cushman, Darby & Cushman

[57] ABSTRACT

A hydraulic vane-type pump is provided having a venting valve which is located immediately at the pressure space of the pump, i.e., avoiding any additional passage means between the pressure space of the pump and the venting valve.

5 Claims, 3 Drawing Sheets

VANE PUMP

The present invention is directed to a hydraulic pump and pertains more particularly to a vane-type pump comprising a pump housing within which a rotor mounted on a rotor shaft is arranged, said rotor supporting a plurality of vanes. Vane-type pumps normally utilize venting valve means adapted to connect the pressure side of the pump with a leakage oil space during the suction process. As soon as the suction process is concluded, said connection between the pressure side of the pump and the leakage oil space will be interrupted so that the pump can build up the desired pressure, a pressure which will in turn close the venting valve in a leakage oil free manner. According to the prior art design of a vane-type pump having a venting valve, the inlet of said valve is connected via a passage to the pressure area of the working space of the pump. Adjacent to the inlet of the venting valve, bolt means are provided together with a seal in said housing, so that no pressurized oil may leak towards the outside.

SUMMARY OF THE INVENTION

It is the primary object of the present invention to overcome the problems of the prior art.

Another object of the present invention is to provide an improved vane-type pump such that the venting valve can be placed in the housing of the pump in a simple manner.

A further object of the present invention is to provide a vane-type pump having a venting valve arranged in such a manner that no sealing means are required, sealing means adapted to prevent the flow of pressure fluid towards the outside.

A still further object of the present invention is to provide a hydraulic vane-type pump which can be manufactured at reduced cost.

In accordance with the present invention a hydraulic vant-type pump is provided having the features mentioned in claim 1.

In accordance with a preferred embodiment of the invention, the pressure space is provided in a first housing member surrounding a first end of the shaft of the rotor, and the inlet of the venting valve is in direct connection with said pressure space.

By locating the venting valve such that its inlet is arranged directly at the pressure space, specifically the pressure inlet port, no leakage towards the outside will occur.

BRIEF DESCRIPTION OF THE DRAWINGS

The above and other objects and advantages of the present invention will become apparent to those of skill in the art from the following description when read in conjunction with the accompanying drawings, wherein.

Figure 1:
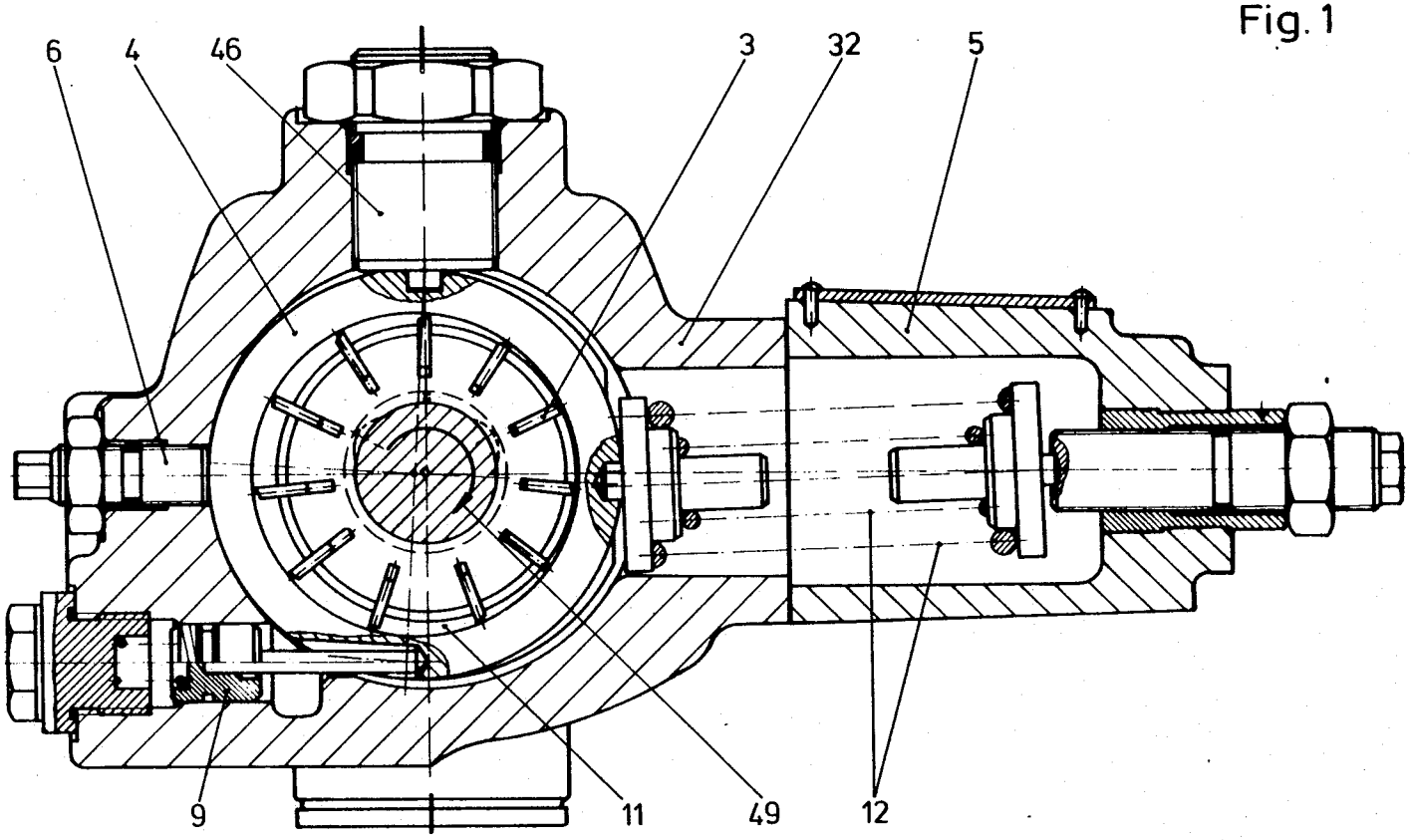
FIG. 1 is a cross-sectional view of the vane-type pump of the invention along line 1—1 in FIG. 2.

The drawings disclose a vane-type pump having a pump housing 1 which comprises a first housing member (cover) 31 and a second housing member 32. The two housing members 31, 32 are connected to each other in a manner not shown and both said housing members form a recess 7 within which a cam ring 4 is arranged in a manner well-known.

An adjustment screw 6 is in engagement with the cam ring 4 so as to adjust the amount of fluid which is supplied by the pump. Also in a known manner, an auxiliary piston 9, a level adjustment screw 46 and a pair of springs 12 act upon said cam ring 4. The pair of springs 12 is located within a spring housing 5.

Within said cam ring 4, a rotor 2 is rotatably mounted. The rotor 2 carries a plurality of vanes, preferably simplex vanes 3. Said vanes 3 form vane chambers, one of said chambers being referred to by the reference numeral 11 in FIG. 1.

The rotor 2 is mounted on a shaft 40. Said shaft 40 comprises a first end in the form of a shaft end 41, and a second end in the form of a shaft pin 42. The first shaft end 41 is rotatably mounted by means of a bearing (not specifically referred to) in an axial bore 44 of the first housing member 31. The first shaft end 41 includes an end face 43 which is provided with gear means. The end face 43 forms the limit of a leakage oil space 48, a space which is created by the axial bore 44. The leakage oil space 48 is further closed by a disk 45. The leakage oil space 48 is connected to the tank by means of a leakage oil drain passage not shown.

The second shaft end 42 extends, as already mentioned, out of the second housing member 32 in the form of a shaft pin. The second shaft end 42 is rotatably mounted in the area of the second housing member 32 by means of a bearing which is shown but not specifically referred to. A seal 47 provides sealing means for the second shaft end 42.

A housing disk 8 is mounted in said second housing member 32 and borders a vane chambers at one side of the rotor 2. On the other side of the rotor 2, a well-known control disk 13 borders the vane chambers. In the embodiment shown in the drawing, the control disk 13 is a stamped metal member which is soldered to the first housing member 31.

A venting valve (relief valve) 10 known per se is located in the pump housing 1. Preferably, the venting valve 10 has the form of a cartridge adapted to be screwed into its desired location. Preferably, the venting valve 10 can be a single piece cartridge, i.e., it does not comprise other thread means, and is therefore press-fit into said bore 21.

The relief valve (venting valve) 10 is located in a radially extending bore 21 in the first housing member 31. The inlet 15 of the venting valve 10 is in direct immediate connection with the pressure space 26 of the pump. The pressure space 26 is provided in the first housing member 31, i.e., in the cover. The pressure space 26 is therefore located in housing member 31, a member which is located opposite to the housing member 32. The housing member 32 being the member from which the shaft 40 projects with its second end 42. The venting valve 10 comprises an outlet space 16 and an outlet passage 17 in an insertable body 14. The outlet space 16 is connected via said outlet passage 17 to a passage 18 which is provided in the housing member 31. Said passage 18 is connected with the leakage oil space 48 formed by bore 44 as already mentioned.

The pressure space 26 is formed by a pressure port 23 and a pressure connecting passage 25 and a pressure inlet passage 24. The pressure port 23 extends substantially radially and comprises a middle axis 22. The pressure inlet passage 24 extends in a substantially axial parallel relationship with respect to shaft 40 and ends at the mentioned control disk 13. The pressure connecting passage 25 provides for the connection between the pressure port 23 and the pressure passage 24.

In accordance with the present invention, it is preferred to locate the venting valve 10 in a bore which is aligned with the bore forming the pressure port 23. In accordance with a preferred embodiment of the invention, the longitudinal axis of the venting valve 10 is located at the axis 22 of the pressure port 23, or is at least located closely to said axis 22. Therefore, the bore 21 can easily be manufacture and it is further easy to insert the valve 10.

Figure 2:
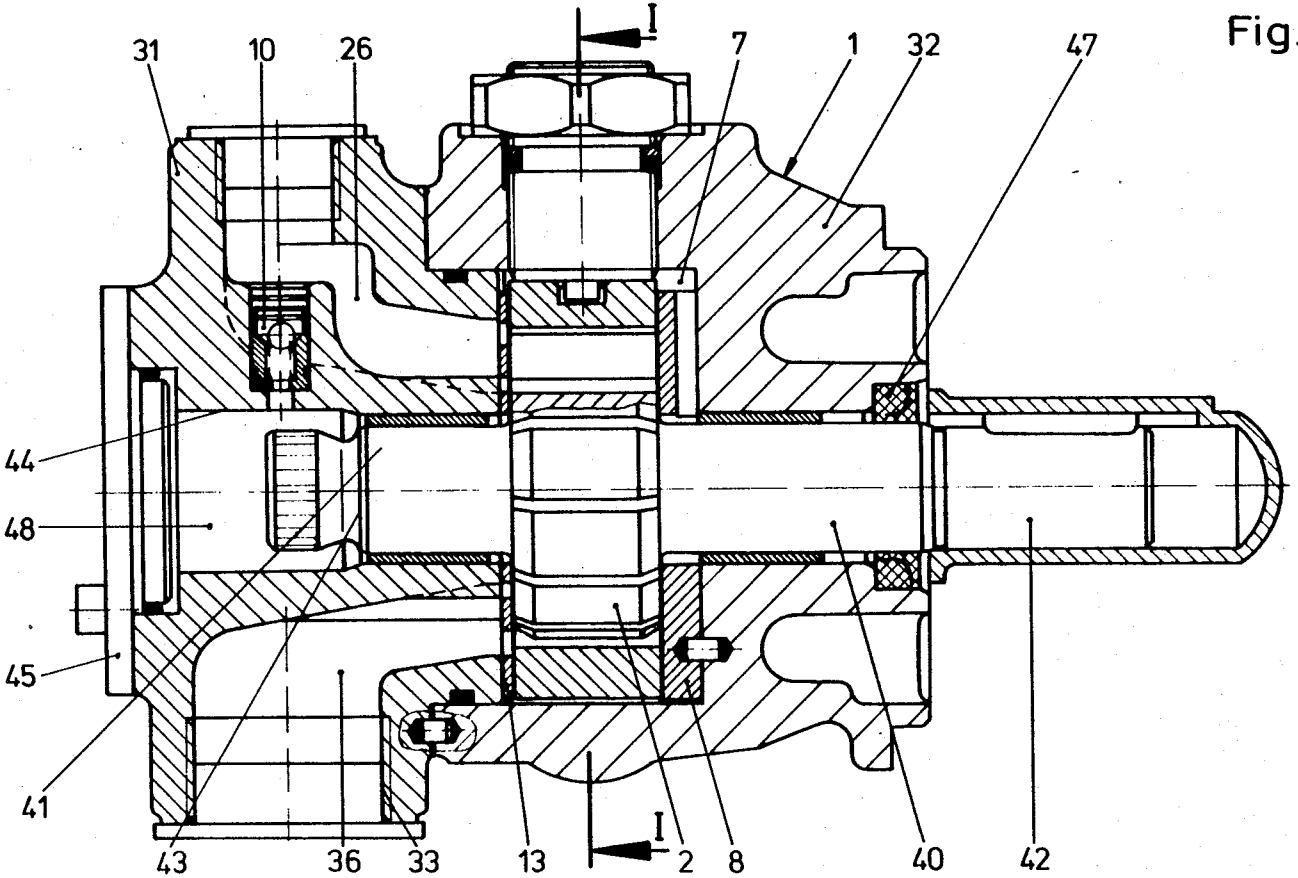
FIG. 2 is a vertical cross-section of the vane-type pump shown in FIG. 1.
Figure 3:
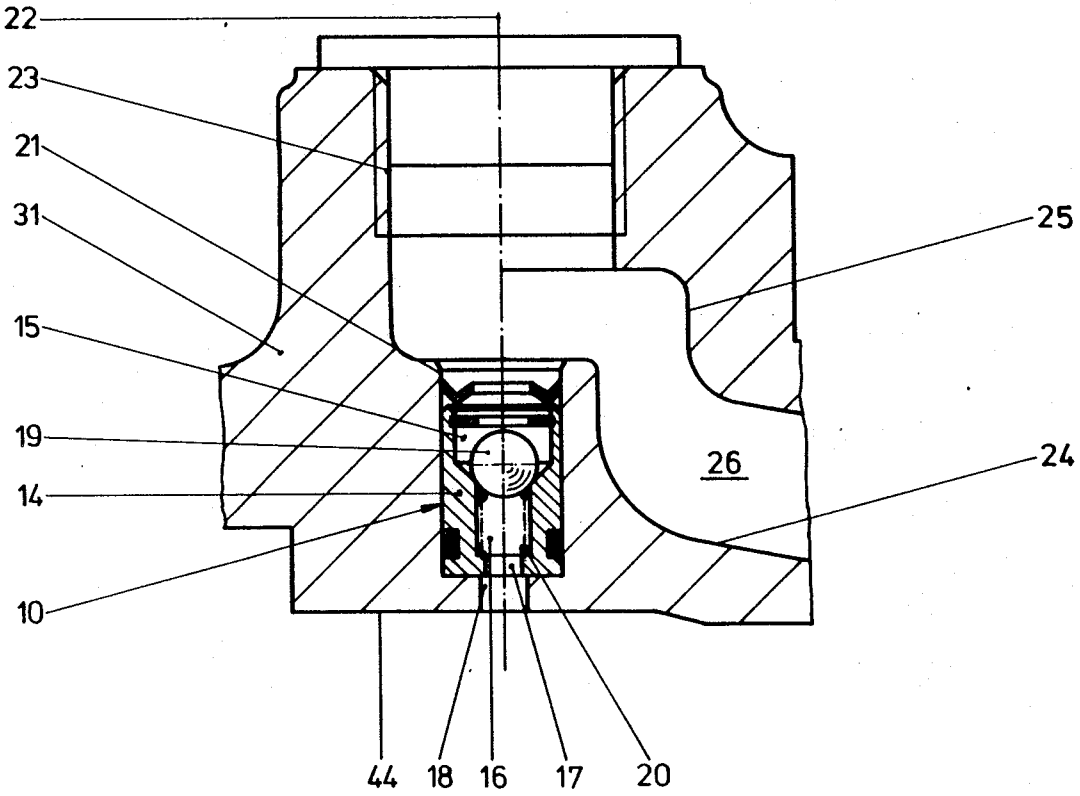
FIG. 3 is an enlarged detail of the cross-sectional view of FIG. 2 in the area of the venting valve.

As is well-known, the pump comprises besides the pressure space a suction space 36 (see FIG. 2). The suction space can be connected via a suction port bore 33 to the tank. The suction space 36 is located in the first housing member or cover 31.

The suction and pumping process of the pump described is well-known and therefore needs not to be described in any detail. As was already mentioned, chambers 11 are provided for transporting the hydraulic fluid. Chambers are formed between each two vanes 3, the rotor 2 and the cam ring 4 as well as cover 31 and housing disk 8. When the rotor 2 is rotated in the direction of arrow 49 in FIG. 1, the chambers 11 will increase in volume starting from the suction space 36 and will be filled with hydraulic fluid. As soon as the maximum volume for the chambers is reached, the chambers 11 will be separated from the suction side. For the further rotation of the rotor 2, the chambers will be connected to the pressure side of the pump. Because the volume of the chambers will then be reduced, the hydraulic fluid is pressed via the pressure port 23 into the system to be supplied with hydraulic fluid.

The adjustment screw 6 already mentioned is used for limiting the maximum amount of fluid supplied by the pump. The mentioned pair of springs 12 maintains the circular-shaped cam ring 4 in its excentric initial position. The maximum operating pressure required by the system is adjusted by means of the pair of springs 12. The pressure built up in the pressure area due to the working resistance of the system being supplied will act upon the inner running surface of the cam ring 4 and onto the auxiliary piston 9 against the force of springs 12. As soon as the force created by the pressure exceeds the force of the springs, the cam ring 4 will be moved from its position of excentricity towards the zero or center position. The amount supplied by the pump will adjust itself to a valve which corresponds to the amount used by the system or load. In the event that the maximum pressure adjusted by the pair of springs 12 is reached, then the pump will adjust itself to a fluid flow of zero. The operating pressure will be maintained and only the leakage oil will be replaced. Due to this adjustment or control characteristic, losses will be low and not much of a heating of the hydraulic fluid will occur.

Venting valve operates as follows: During the suction process of the pump, closing member 19 of the valve 10 will be lifted from its valve seat and consequently the pressure side of the pump is connected to the leakage oil space 48 which is at atmospheric pressure. Therefore, at the pressure side of the pump, no pressure buildup can occur during the suction process. As soon as the suction process is finished and the pump supplies liquid or in general terms, a pressure medium, for example oil, the higher viscosity of the pressure medium (compared with the viscosity of air) will move the closing member 19 into the direction of the valve seat against the relatively low force of the pressure spring 20. As a consequence, the connection between the pressure side of the pump and the leakage oil space 48 is interrupted. Therefore, the desired pressure buildup will occur in the pump, a pressure which will in turn close the venting valve 10 so that no leakage oil will flow. The venting valve 10 will open only if the pump is at standstill and the pressure at the pressure side has decreased so that the pressure spring 20 is in a position to lift the closing member 19 from its valve seat.

We claim:

1. A vane-type pump comprising:

a housing, a rotor, a plurality of vanes supported by said rotor, a rotor shaft onto which said rotor is mounted, a leakage oil space defined in said housing, said rotor shaft having a first end and a second end, said first end ending within said housing and defining a border of said leakage oil space, said second end extending out of said housing and forming a shaft pin for driving said shaft, said housing defining a suction space and a pressure space, said suction space and said pressure space being operatively coupled to vane chambers formed by said vanes, a pressure port bore defined in said housing and coupled to said pressure space, said pressure port bore having a longitudinal axis, and a venting valve disposed within said housing immediately adjacent said pressure port bore and having an inlet directly coupled to said pressure port bore and an outlet coupled to said leakage oil space, a longitudinal axis of said venting valve being parallel to said axis of said pressure port bore such that a direct connection can be provided between the pressure port bore and leakage oil space.

2. The pump of claim 1 wherein said pump housing comprises a first housing member and a second housing member, said shaft pin being adapted to extend out of said second housing member and the pressure port bore is arranged in said first housing member surrounding said first shaft end.

3. The pump of claim 2 wherein the pressure port bore extends radially from said shaft in said first housing member.

4. The pump of claim 3 wherein said venting valve comprises an insert body defining an outlet space and an outlet, said first housing member including a passage coupled to said leakage oil space, said outlet space being connected to said leakage oil space via said outlet defined by said insert body and said passage.

5. The pump of claim 1 wherein the venting valve is provided in the form of a cartridge threadingly received in a bore defined in said first housing member.

* * * * *